US011090829B2

(12) United States Patent
King et al.

(10) Patent No.: US 11,090,829 B2
(45) Date of Patent: Aug. 17, 2021

(54) SLICING MACHINES AND METHODS FOR SLICING PRODUCTS

(71) Applicant: Urschel Laboratories, Inc., Chesterton, IN (US)

(72) Inventors: Daniel Wade King, Valparaiso, IN (US); Scott Alan Klockow, Kouts, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 16/591,823

(22) Filed: Oct. 3, 2019

(65) Prior Publication Data

US 2020/0108521 A1 Apr. 9, 2020

Related U.S. Application Data

(60) Provisional application No. 62/740,653, filed on Oct. 3, 2018.

(51) Int. Cl.
*B26D 7/06* (2006.01)
*B26D 1/03* (2006.01)

(52) U.S. Cl.
CPC ..... *B26D 7/0691* (2013.01); *B26D 1/03* (2013.01); *B26D 2210/02* (2013.01)

(58) Field of Classification Search
CPC ..... B26D 7/0691
USPC ..... 83/403
See application file for complete search history.

(56) References Cited

U.S. PATENT DOCUMENTS 3,139,127 A 6/1964 Urschel et al.
3,139,130 A 6/1964 Urschel et al.
3,528,712 A * 9/1970 Vacca ..... B64C 27/001 384/536
4,648,296 A 3/1987 Wisdom et al.
4,949,612 A 8/1990 Julian
5,335,921 A * 8/1994 Orlowski ..... F16C 35/047 277/637

(Continued)

FOREIGN PATENT DOCUMENTS

KR 20140114746 9/2014

OTHER PUBLICATIONS

International Search Report for International Application No. PCT/US2019/054438, dated Jan. 16, 2020, (3-pages).

*Primary Examiner* — Kenneth E Peterson
(74) *Attorney, Agent, or Firm* — Hartman Global IP Law; Gary M. Hartman; Domenica N. S. Hartman

(57) ABSTRACT

Machines and methods for slicing products into lattice-type slices or chips. The methods and machines utilize a cutting head having an annular shape that defines an axis of the cutting head, and an impeller assembly coaxially mounted within the interior of the cutting head for rotation about the axis of the cutting head. The cutting head having at least one knife at a perimeter thereof and extending radially inward of the cutting head. The impeller assembly has a base, a cavity within the base, a central opening to the cavity within the base, and equi-angularly spaced tubular guides extending radially outward from the base for delivering products within the cavity toward the perimeter of the cutting head as the impeller assembly rotates within the cutting head. The impeller assembly includes features with the ability to increase product throughput and increase the useful lives of the impeller assembly and cutting head.

9 Claims, 16 Drawing Sheets

(56) References Cited

U.S. PATENT DOCUMENTS

| | | | | |
|---|---|---|---|---|
| 5,343,791 | A * | 9/1994 | Julian | B26D 1/29 83/402 |
| 10,265,877 | B2 * | 4/2019 | Bucks | B26D 7/0691 |
| 10,647,014 | B2 * | 5/2020 | Khan | B26D 1/03 |
| 2009/0202694 | A1 | 8/2009 | Julian et al. | |
| 2011/0037332 | A1 * | 2/2011 | Neuroth | F16C 17/18 310/87 |
| 2015/0140198 | A1 | 5/2015 | Rawlings et al. | |
| 2019/0152082 | A1 * | 5/2019 | Turatti | B26D 3/16 |

* cited by examiner

SLICING MACHINES AND METHODS FOR SLICING PRODUCTS

CROSS-REFERENCE TO RELATED APPLICATIONS

This application claims the benefit of U.S. Provisional Application No. 62/740,653 filed Oct. 3, 2018, the contents of which are incorporated herein by reference.

BACKGROUND OF THE INVENTION

The present invention generally relates to methods and machines for cutting products, including but not limited to food products. The invention particularly relates to machines equipped with a cutting head and an impeller assembly adapted to rotate within the cutting head, wherein the impeller assembly transports products to knives situated in the cutting head for slicing the products into slices or chips of the lattice type.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC® and CCL machines are centrifugal-type slicers capable of slicing a wide variety of products at high production capacities. Whereas the Model CC® line of machines is particularly adapted to produce uniform slices, strip cuts, shreds and granulations, the Model CCL line is particularly adapted to produce slices or chips of a waffle or lattice type (hereinafter, collectively referred to as a lattice), nonlimiting examples of which are represented in FIG. 1.

From top to bottom, the images in FIG. 1 represent fine, coarse, and deep lattice cuts, which may be used to produce, as nonlimiting examples, lattice potato chips and potato waffle fries. As evident from FIG. 1, the opposing surfaces of the slices are characterized by a periodic pattern having a corrugated or sinusoidal shape with rounded peaks and valleys when viewed edgewise, though sharper peaks and valleys are also possible. The lattice cut is produced by sequentially crosscutting a product at two different angles, typically (though not necessarily) ninety degrees apart, using one or more knives each having a cutting edge formed to have the desired periodic pattern of the slices to be produced. Such a knife is referred to herein as a corrugated knife, which is intended to denote the presence of a cutting edge on the knife that is characterized by peaks and valleys when the knife is viewed edgewise, but is not restricted to cutting edges having peaks and valleys with any particular shape or pattern, periodic or otherwise.

Original versions of the Model CCL are represented in U.S. Pat. Nos. 3,139,127 and 3,139,130, whose contents are incorporated herein by reference. A representation of a Model CCL machine 10 is shown in FIG. 2, and drawings of a Model CCL machine 10 adapted from U.S. Pat. Nos. 3,139,127 and 3,139,130 are included herein as FIGS. 3 through 5. The machines 10 depicted in FIGS. 2 through 5 include a frame 12 that supports a power unit 14, a stationary cutter assembly (cutting head) 16, and a carriage or conveyor (impeller) assembly 18 that is rotatably disposed within the cutting head 16 for feeding products to the cutting head 16. The cutting head 16 and impeller assembly 18 are coaxial, and the cutting head 16 remains stationary while the impeller assembly 18 rotates within the cutting head 16 about their common axis. The cutting head 16 and impeller assembly 18 are enclosed in a housing 20, and products are delivered to the cutting head 16 and impeller assembly 18 through a feed hopper 22.

FIG. 4 represents a perspective view of the machine 10 of FIG. 3, with the hopper 22 retracted and the housing 20 and cutting head 16 removed to expose the impeller assembly 18, which is represented as having four tubular guides 24 that deliver products to the cutting head 16. As seen in FIGS. 3 and 4, each tubular guide 24 has a toothed flange 25 that engages a stationary ring 27 below the impeller assembly 18, so that rotation of the impeller assembly 18 about its vertical axis causes the tubular guides 24 to rotate in unison about their respective longitudinal axes. FIG. 5 is an isolated top fragmentary view of the cutting head 16 and impeller assembly 18 of FIG. 3, and shows two of four knife stations located at the perimeter of the cutting head 16. Each cutting station is equipped with a corrugated cutting knife 26 secured to a segment 28 of the cutting head 16 between a knife holder 30 and clamp 32. The assemblage of a knife 26, knife holder 30, and clamp 32 forms what will be referred to herein as a knife assembly 34. Rotation of the tubular guides 24 in unison about their respective longitudinal axes results in a desired lattice cut being generated in products as they encounter the knives 26. For example, the four tubular guides 24 may cause products to make an approximate one-quarter turn between each of the four knife stations of the machine 10 to create ninety-degree angular cuts in the slices. The machine 10 can be constructed to have fewer or more tubular guides 24 and/or knife stations, and the rotation of the tubular guides 24 can be synchronized to complete any rotation between the knife stations to achieve any desired angularity between slices.

From FIG. 3, it is evident that the interior of the cutting head 16 has a spheroidal surface. Consequently, the knives 26, knife holders 30, and clamps 32 also have spheroidal shapes. The hopper 22 delivers products to the impeller assembly 18, and centrifugal forces cause products to move outward into engagement with the interior spheroidal surface of the cutting head 16, including the interior surfaces of the knife holders 30. The interior surfaces of the knife holders 30 are referred to herein as registration surfaces of the knife holders 30. While engaged with the registration surfaces, in regular succession the products encounter and are sliced by the knives 26 circumferentially spaced within the cutting head 16.

FIG. 6 represents a fragmentary perspective view of a cutting head 16 and impeller assembly 18 corresponding to the machine 10 shown in FIGS. 3, 4, and 5, and is useful for further describing operating principles of a Model CCL. Product delivered to the feed hopper (not shown) enters the impeller assembly 18 through a central opening 42 at the top of the impeller assembly 18. The impeller assembly 18, including its four tubular guides 24, rotates about the vertical axis shared with the cutting head 16. Centrifugal forces urge products 35 within the tubular guides 24 radially outward through the tubular guides 24 toward the radially outward extremities thereof as the tubular guides 24 rotate in unison about their respective longitudinal axes. With the assistance of longitudinal ribs or splines 38 within the interior passage of each tubular guide 24, the product 35 within each guide 24 also rotates about its horizontal axis as the impeller assembly 18 rotates about its vertical axis. As centrifugal forces hold the products 35 firmly against the spheroidal interior surface of the cutting head 16, the tubular guides 24 cause the products 35 to turn between each successive knife station, resulting in a lattice cut being generated in slices 36 as the knives 26 are encountered. As previously noted, a nonlimiting example is for the tubular guides 24 of the embodiment of FIGS. 3 through 6 to cause the products 35 to make an approximate one-quarter turn between each of the four knife stations, resulting in the slices 36 having a ninety-degree lattice cut as shown in FIG. 6.

FIGS. 7 and 8 schematically represent, respectively, cross-sectional views of the impeller assembly 18 of FIGS. 3 through 6 and a second embodiment of the impeller assembly 18 whose tubular guides 24 are more than twice as long as the tubular guides 24 of FIGS. 3 through 6. The cross-sectional views of the impeller assemblies 18 reveal the interior passages 40 of three of the four tubular guides 24 of each assembly 18, as well as the central opening 42 of each impeller assembly 18 through which products enter a cavity 43 within the impeller assembly 18 (e.g., from the hopper 22 of FIGS. 2 through 4) before being directed into one of its tubular guides 24. FIGS. 9 and 11 and FIGS. 10 and 12 are further views of, respectively, the impeller assemblies 18 of FIGS. 7 and 8, and evidence the ability of the impeller assembly 18 of FIGS. 8, 10, and 12 to more readily accommodate large and particularly elongate products (e.g., potatoes) 35, in terms of the longer tubular guides 24 of the assembly 18 of FIGS. 8, 10, and 12 reducing the risk of undesired interaction between the product 35 being sliced and subsequent products entering the cavity 43 of the assembly 18. FIG. 13 is a perspective view of the impeller assembly 18 of FIGS. 8, 10, and 12.

Further descriptions pertaining to the construction and operation of Model CCL machines are contained in U.S. Pat. Nos. 3,139,127 and 3,139,130.

CCL machines of the types described above have performed exceedingly well. Even so, there is an ongoing desire for machines of this type having further capabilities, including the ability to accommodate longer and/or larger products while simultaneously maintaining or increasing product throughput.

BRIEF DESCRIPTION OF THE INVENTION

The present invention provides methods and equipment suitable for slicing products into slices or chips of the lattice type.

According to one aspect of the invention, a slicing machine includes a cutting head having an annular shape that defines an axis of the cutting head, and an impeller assembly coaxially mounted within the interior of the cutting head for rotation about the axis of the cutting head in a rotational direction relative to the cutting head. The cutting head has at least one knife at a perimeter thereof and extends radially inward of the cutting head. The impeller assembly includes a base, a cavity within the base, a central opening to the cavity within the base, and an odd number of equi-angularly spaced tubular guides extending radially outward from the base for delivering products within the cavity toward the perimeter of the cutting head as the impeller assembly rotates within the cutting head. Each of the tubular guides rotates about an axis thereof so that products within the tubular guides rotate about axes thereof while the impeller assembly rotates about the axis of the cutting head.

According to another aspect of the invention, a slicing machine includes a cutting head having an annular shape and at least one knife at a perimeter thereof that extends radially inward of the cutting head. An impeller assembly is coaxially mounted within the interior of the cutting head for rotation about the axis of the cutting head in a rotational direction relative to the cutting head. The impeller assembly includes a base, a cavity within the base, a central opening to the cavity within the base, equi-angularly spaced mounting tubes extending from the base, and tubular guides rotatably mounted on the mounting tubes for delivering products within the cavity toward the perimeter of the cutting head as the impeller assembly rotates within the cutting head. Each tubular guide rotates about an axis thereof so that products within the tubular guides rotate about axes thereof while the impeller assembly rotates about the axis of the cutting head. Each tubular guide is supported on a corresponding one of the mounting tubes by a bearing assembly comprising at least two bearings that are axially spaced apart along the mounting tube and a spacer between the bearings. The spacer includes an inner spacer sleeve contacting the mounting tube and engaging inner races of the bearings, an outer spacer sleeve between the tubular guide and the inner spacer sleeve and engaging outer races of the bearings such that the outer spacer sleeve is able to rotate with the tubular guide and the inner spacer sleeve does not rotate, and a sacrificial ring disposed in an annular space defined by and between a shoulder of the inner spacer sleeve and a flange of the outer spacer sleeve. An axial gap is present between the flange of the outer spacer sleeve and the sacrificial ring to permit the outer spacer sleeve to rotate relative to the inner spacer sleeve, and in the event that either of the bearings of a tubular guide fails, the tubular guide shifts radially outward due to centrifugal forces and the outer spacer sleeve abuts the sacrificial ring resulting in contact between the outer spacer sleeve and sacrificial ring to prevent contact between the tubular guide and the knives of the cutting head.

Other aspects of the invention include methods for cutting products using machines of the types described above to produce sliced products.

Technical effects of the machines and methods described above preferably include the ability to accommodate large and especially large elongate products, maintain or increase product throughput, and potentially increase the useful lives of the impeller assembly and cutting head relative to existing machines that produce slices and chips of the lattice type.

Other aspects and advantages of this invention will be appreciated from the following detailed description.

DETAILED DESCRIPTION OF THE INVENTION

Figure 1:
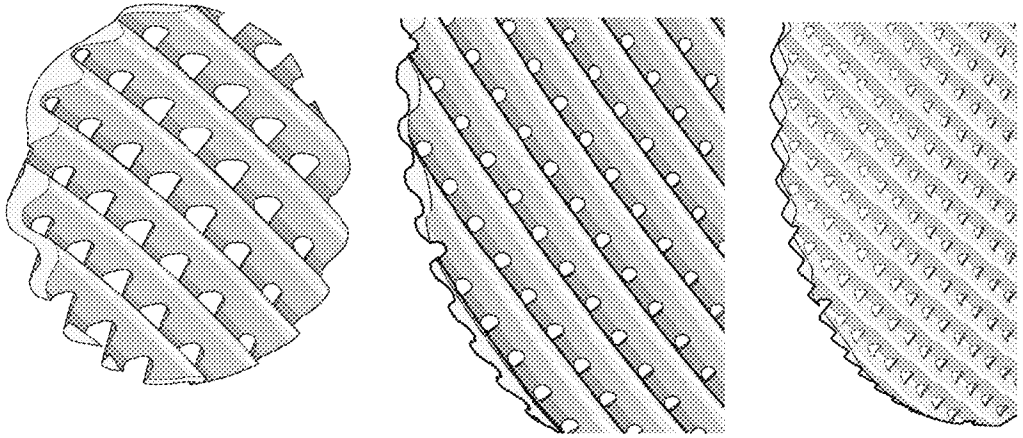
FIG. 1 schematically represents lattice-type slices that may be produced with machines such as the Model CCL manufactured by Urschel Laboratories, Inc.
Figure 2:
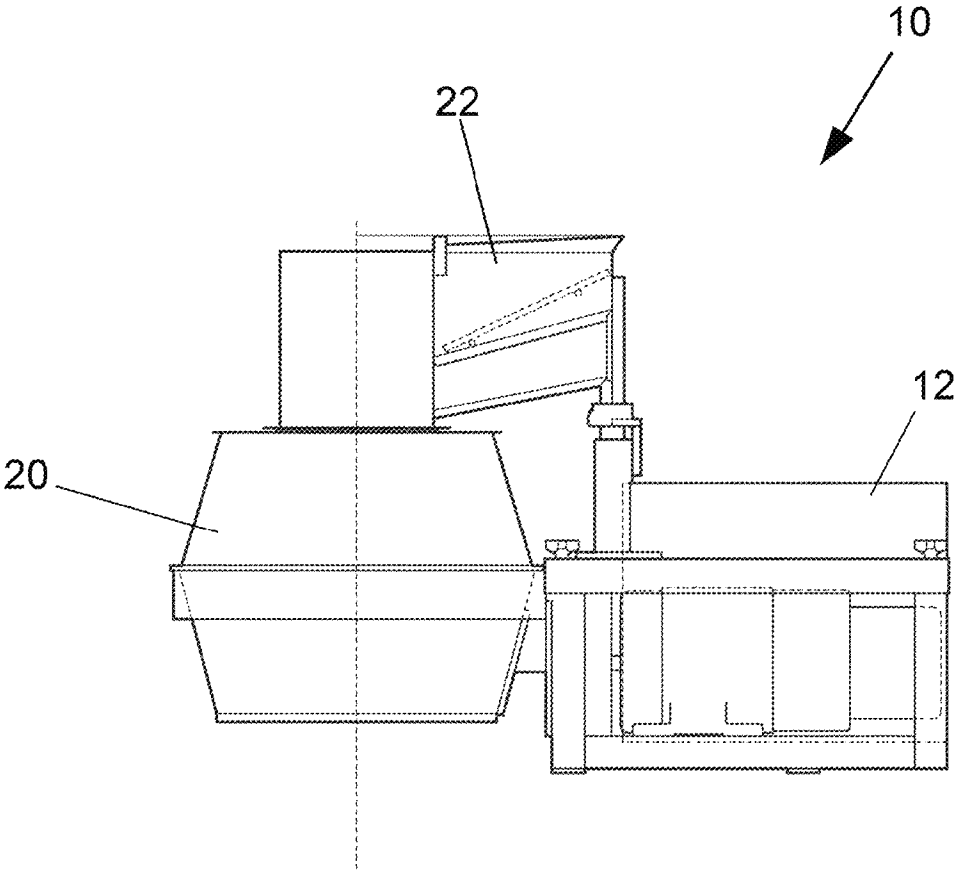
FIG. 2 is a side view representing an exemplary Model CCL machine known in the art.
Figure 3:
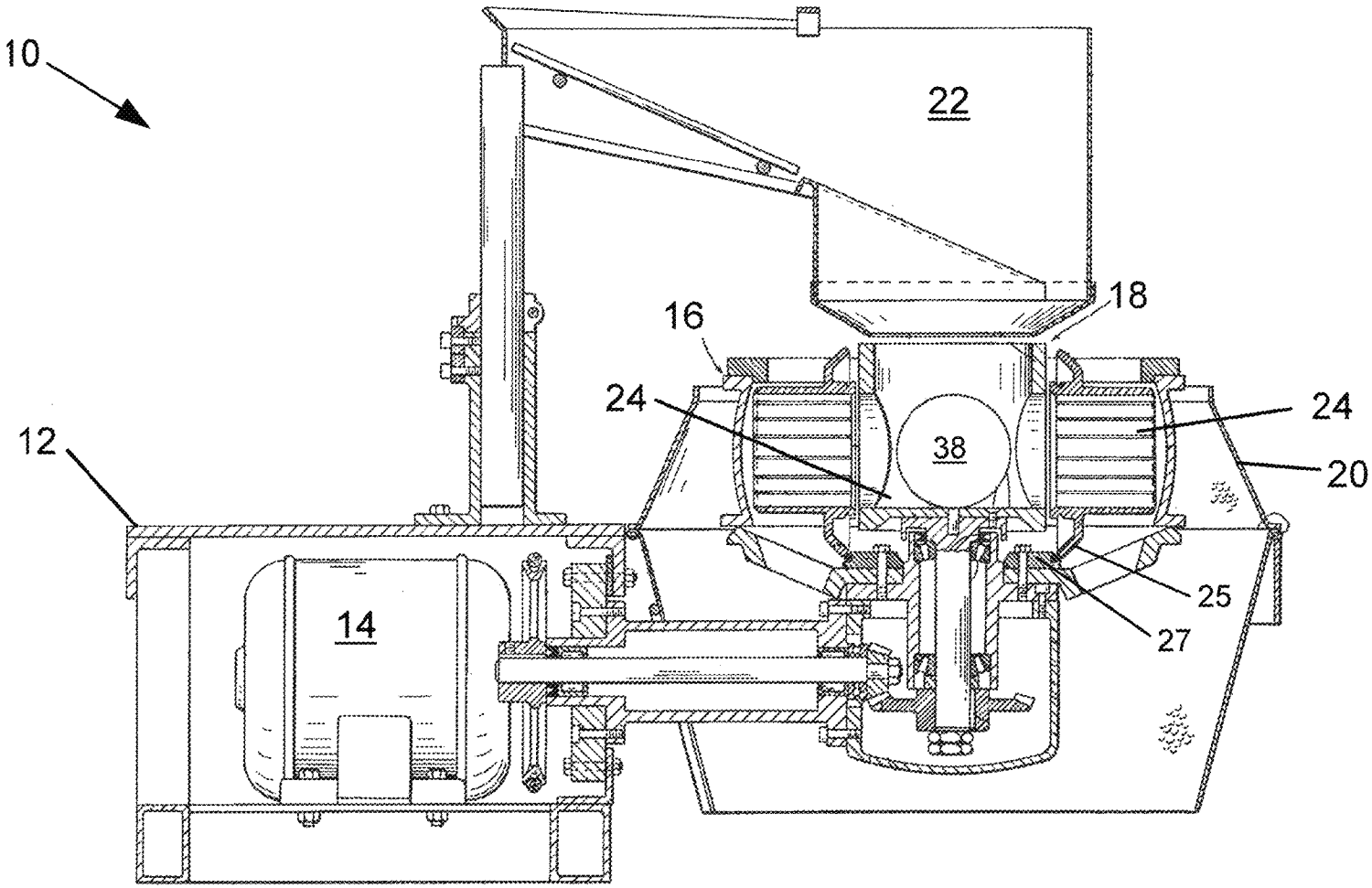
FIG. 3 is a side view in partial cross-section of a Model CCL machine.
Figure 4:
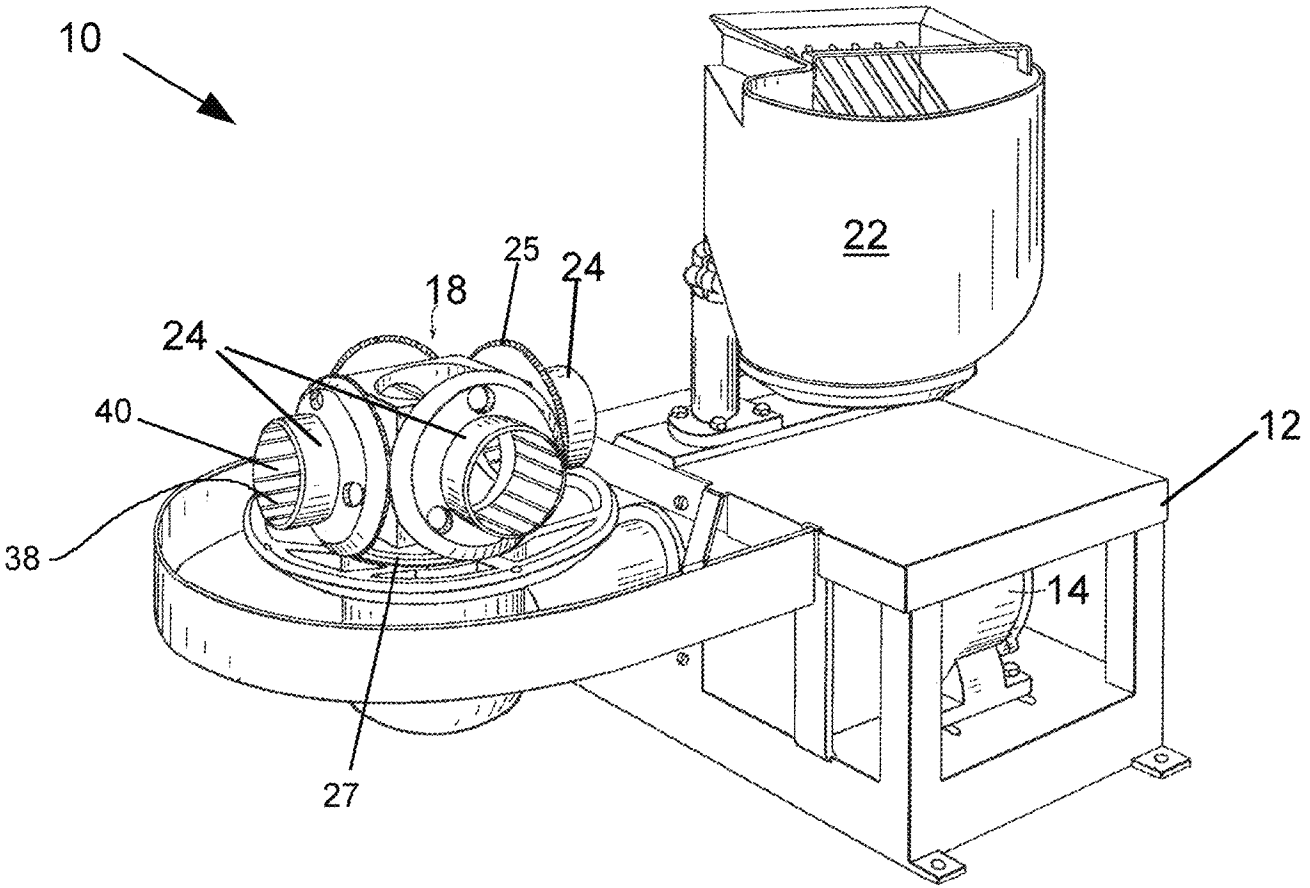
FIG. 4 is a perspective view of the machine of FIG. 3, with a housing and cutting head removed to expose an impeller assembly.
Figure 5:
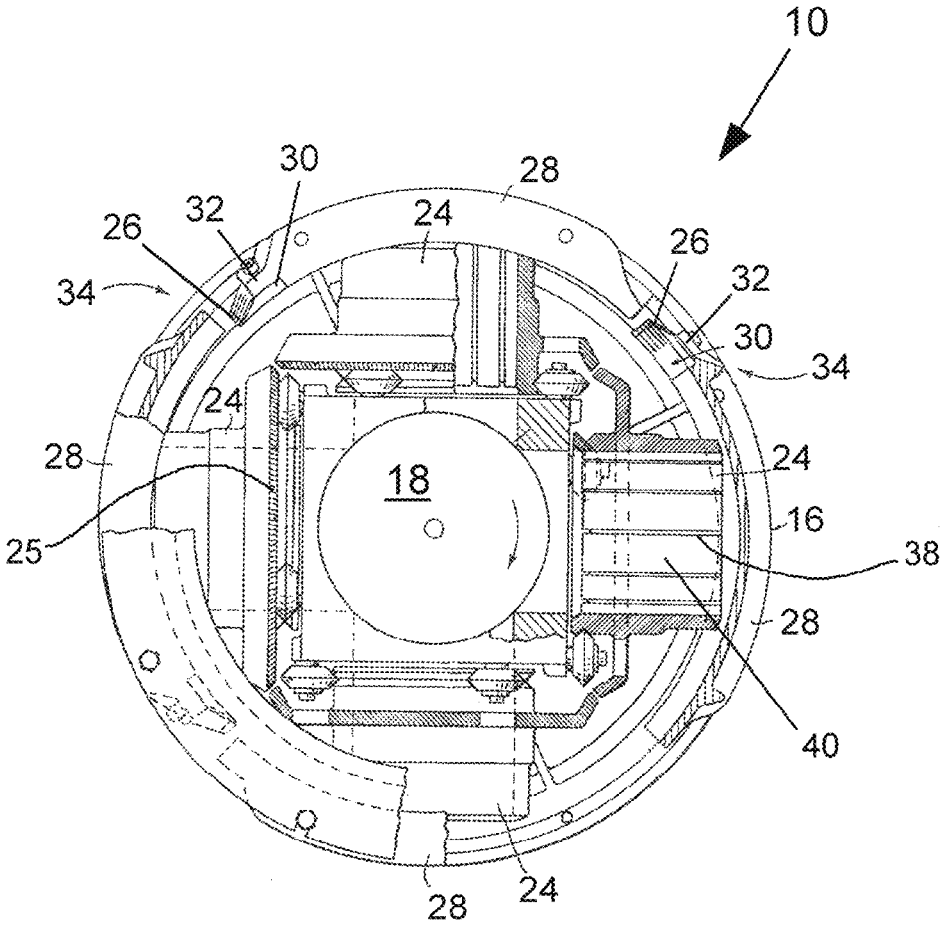
FIG. 5 is a top fragmentary view of the cutting head and impeller assembly of the machine of FIG. 3.
Figure 6:
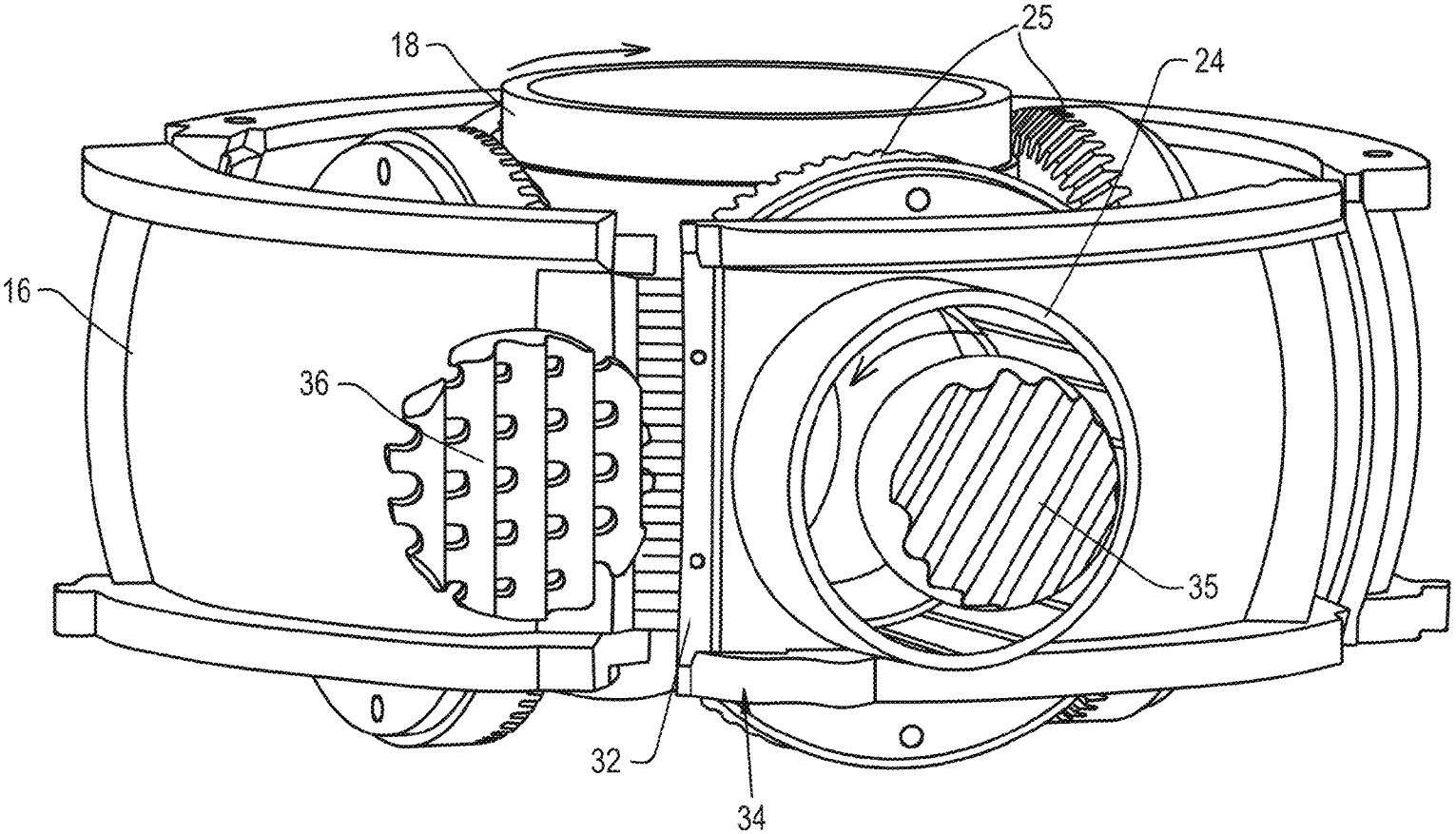
FIG. 6 is a perspective view of a cutting head and impeller assembly of an exemplary Model CCL machine.
Figure 7:
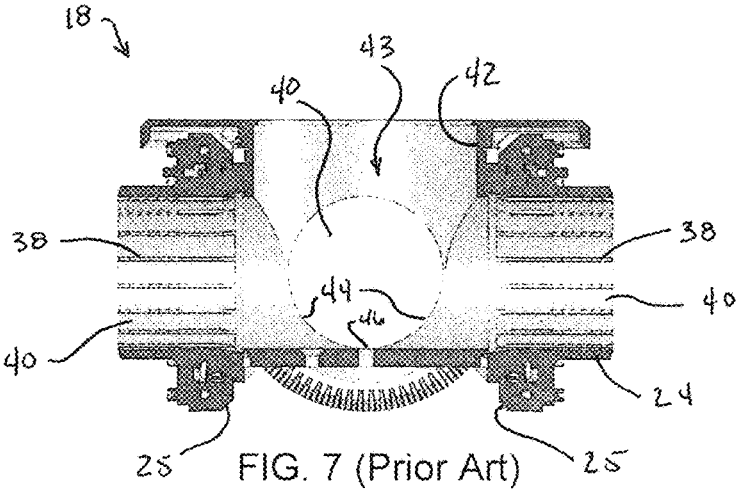
FIG. 7 (Prior Art)
FIGS. 7, 9, and 11 are cross-sectional views of an impeller assembly of the type shown in FIGS. 2 through 6, and FIGS. 8, 10, and 12 are cross-sectional views an impeller assembly similar to that shown in FIGS. 2 through 6, but with longer tubular guides.
Figure 8:
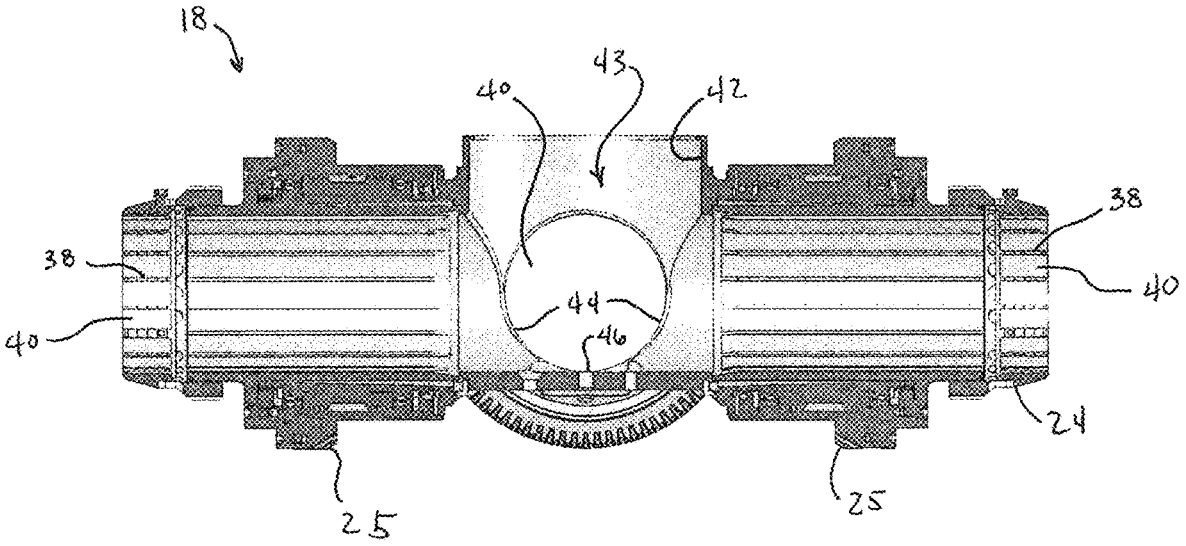
FIG. 8 (Prior Art)
Figure 9:
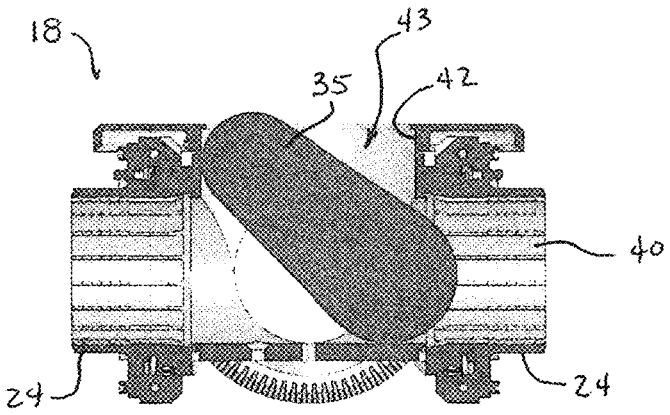
FIG. 9 (Prior Art)
Figure 10:
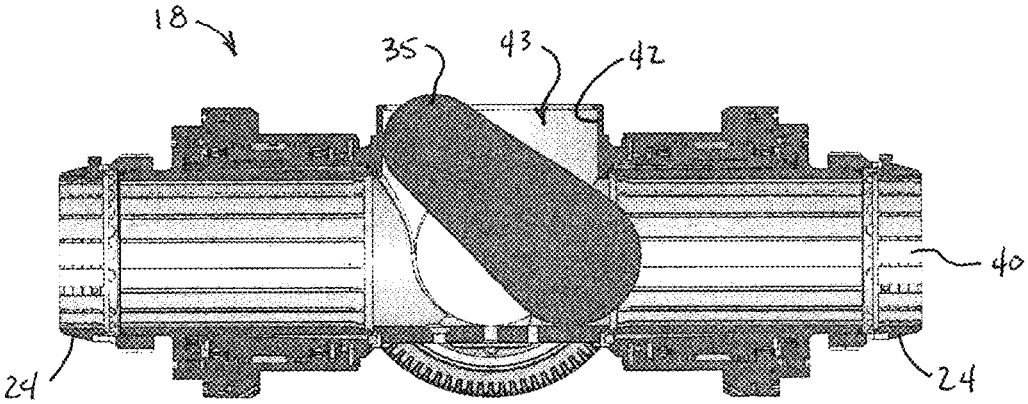
FIG. 10 (Prior Art)
Figure 11:
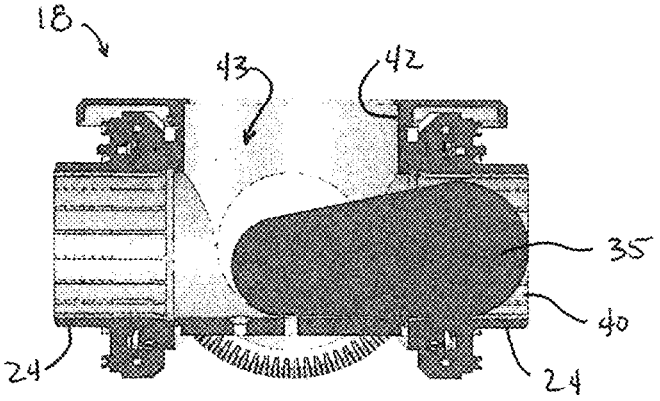
FIG. 11 (Prior Art)
Figure 12:
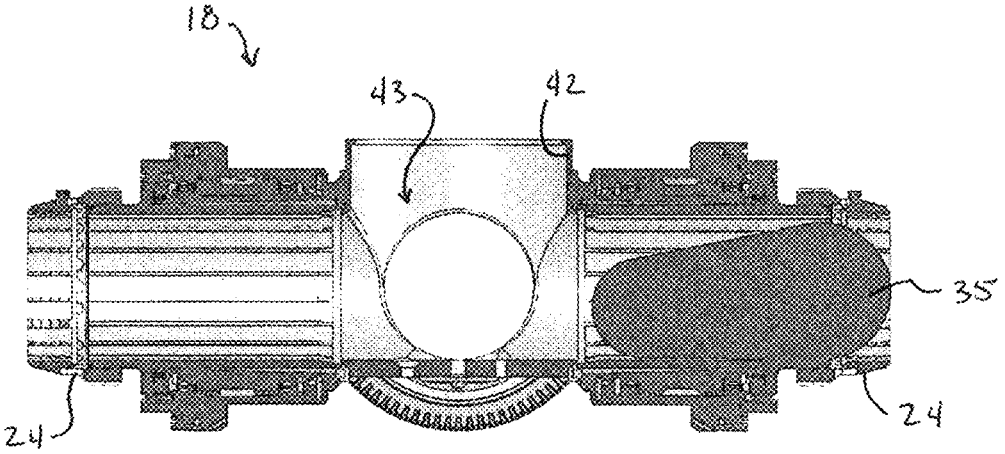
FIG. 12 (Prior Art)

FIGS. 14 through 17 represent a nonlimiting embodiment of an impeller assembly 50 adapted for use in a centrifugal-type machine (slicer) capable of slicing a wide variety of products at high production capacities, and FIGS. 18 through 22 depict optional components of the assembly 50. The impeller assembly 50 is configured similarly to the impeller assemblies 18 represented in FIGS. 2 through 13. Similar to the Model CCL line of machines, the impeller assembly 50 is particularly adapted to produce slices or chips of a waffle or lattice type, including those represented in FIG. 1. The impeller assembly 50 has certain components and features similar to the impeller assemblies 18 represented in FIGS. 2 through 13, and in some instances might serve as a replacement for such assemblies 18. As such, the nonlimiting embodiment of the impeller assembly 50 shown in FIGS. 14 through 17 will be described hereinafter in reference to a Model CCL machine having components arranged as described for the machine 10 in FIGS. 2 through 5, though it will be appreciated that the teachings of the invention are more generally applicable to a variety of machines. Furthermore, though the impeller assembly 50 and components thereof represented in FIGS. 14 through 22 will be discussed in reference to slicing food products, it should be understood that the impeller assembly 50 can be utilized to cut other types of products.

Figure 13:
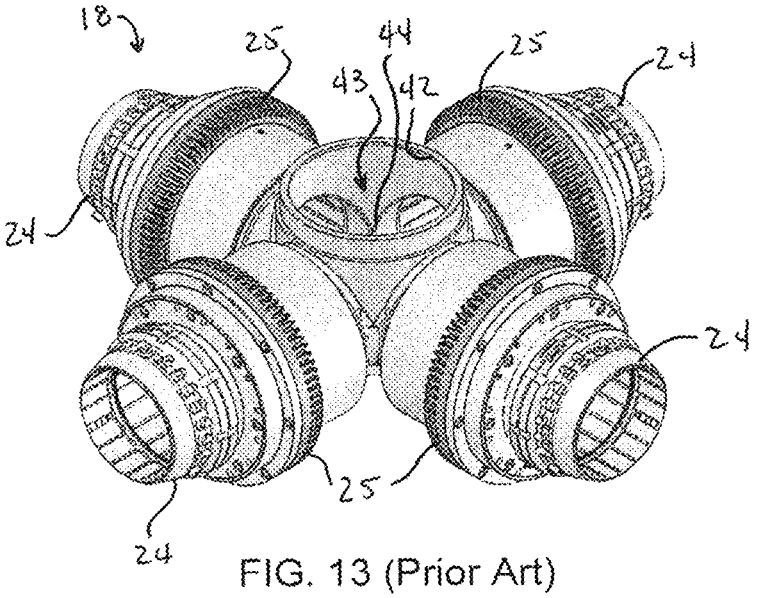
FIG. 13 (Prior Art)
FIG. 13 is a perspective view representing the impeller assembly of FIGS. 8, 10, and 12.
Figure 14:
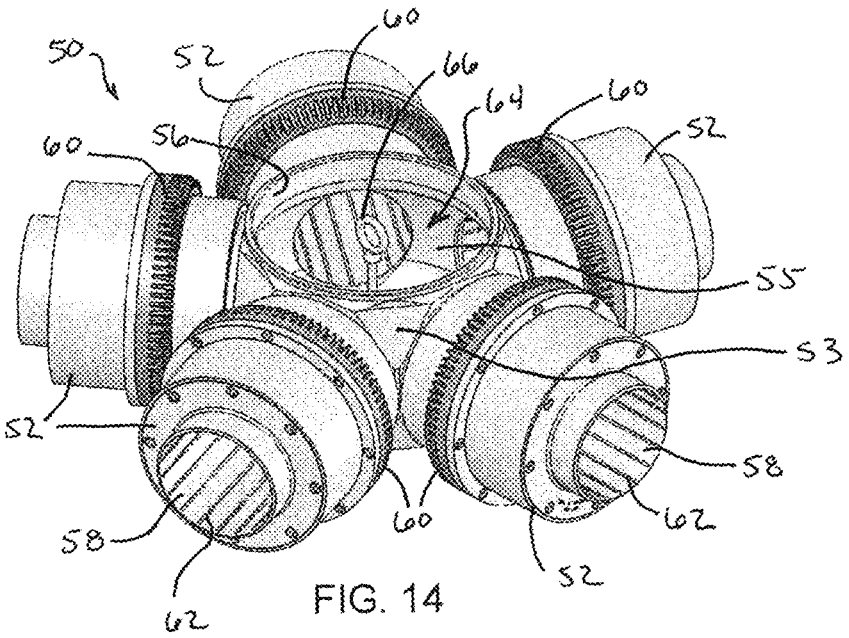
FIG. 14 is a perspective view representing an impeller assembly in accordance with a nonlimiting embodiment of the present invention.

FIG. 14 is a perspective view of the impeller assembly 50 similar to the view of the prior art impeller assembly 18 shown in FIG. 13, and FIGS. 15, 16, and 17 are cross-sectional views of the impeller assembly 50 similar to the views of the prior art impeller assemblies 18 shown in FIGS. 7 through 12. As with the prior art assemblies 18, the impeller assembly 50 is adapted to be rotatably disposed within a cutting head, e.g., the cutting head 16 of FIGS. 3, 4, and 5, for feeding products to the cutting head 16. The cutting head 16 and impeller assembly 50 are coaxial, and the cutting head 16 remains stationary while the impeller assembly 50 rotates within the cutting head 16 about their common axis. In view of similarities between the impeller assembly 50 of FIGS. 14 through 17 and the prior art impeller assemblies 18 of FIGS. 2 through 13, the following discussion will focus primarily on certain aspects of the impeller assembly 50, whereas other aspects not discussed in any detail may be, in terms of structure, function, materials, etc., essentially as was described for the impeller assemblies 18 of FIGS. 2 through 13.

To facilitate the description provided below of the impeller assembly 50 and its components represented in FIGS. 14 through 22, on the basis of a coaxial arrangement of the impeller assembly 50 with a cutting head in which it is installed, relative terms including but not limited to "axial," "circumferential," "radial," etc., and related forms thereof may also be used below to describe the nonlimiting embodiment represented in the drawings. Furthermore, as used herein, "trailing" (and related forms thereof) refers to a position on the impeller assembly 50 that follows or succeeds another in the direction of rotation of the impeller assembly 50 as it rotates within a cutting head, whereas "leading" (and related forms thereof) refers to a position on the impeller assembly 50 that is ahead of or precedes another in the direction opposite the rotation of the impeller assembly 50. All such relative terms are intended to indicate the construction, installation, and use of the impeller assembly 50 and therefore help to define the scope of the invention.

The perspective view of the impeller assembly 50 in FIG. 14 shows the assembly 50 as having more than four equiangularly spaced tubular guides 52 for delivering products radially outward to a cutting head. In the illustrated embodiment, an odd number (five) of tubular guides 52 are mounted to and extend from a central base 53. Each tubular guide 52 has a passage 58 that defines an opening to a central cavity 64 within the base 53, and openings of each adjacent pair of tubular guides 52 is separated by an interior wall 55 of the base 53. As evident from the cross-sectional views of the assembly 50 shown in FIGS. 15 through 17, a consequence of the odd number of tubular guides 52 is that none of the openings of the tubular guides 52 is directly diametrically opposite any other opening to any other tubular guide 52, and none of the interior wall 55 is directly diametrically opposite any other interior wall 55. Instead, each passage opening is directly diametrically opposite an interior wall 55 between and separating the openings of an adjacent pair of tubular guides 52, and each interior wall 55 is directly diametrically opposite an opening to a tubular guide 52. A possible advantage to this configuration is a likelihood of improved product throughput because, since none of the interior walls 55 is directly diametrically opposite any other interior wall 55, a large product cannot become trapped between diametrically opposite interior walls 55. In contrast, and as evident from FIGS. 7 through 13, each interior wall 44 (FIGS. 7 and 8) that is present between an adjacent pair of passages 40 of the prior art impeller assemblies 18 is directly diametrically opposite another interior wall 44.

Figure 21:
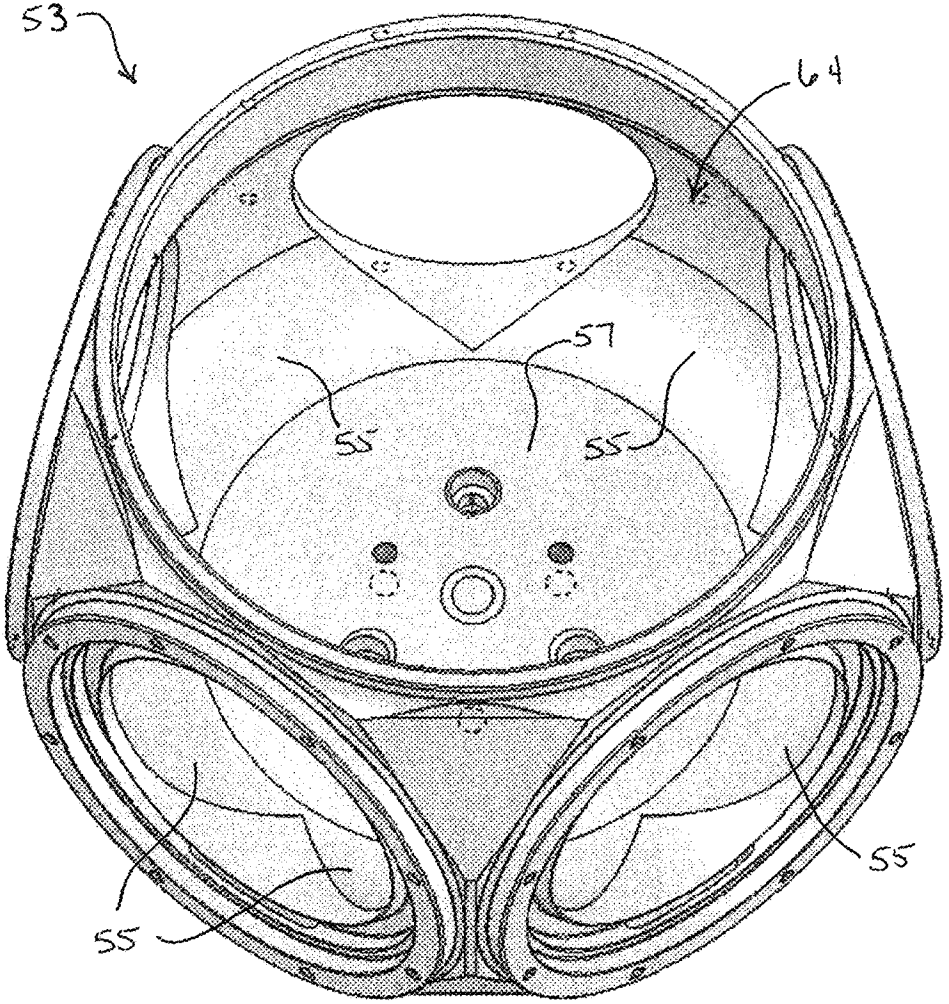
FIG. 21 is a perspective view representing a base of the impeller assembly of FIGS. 14 through 17.
Figure 22:
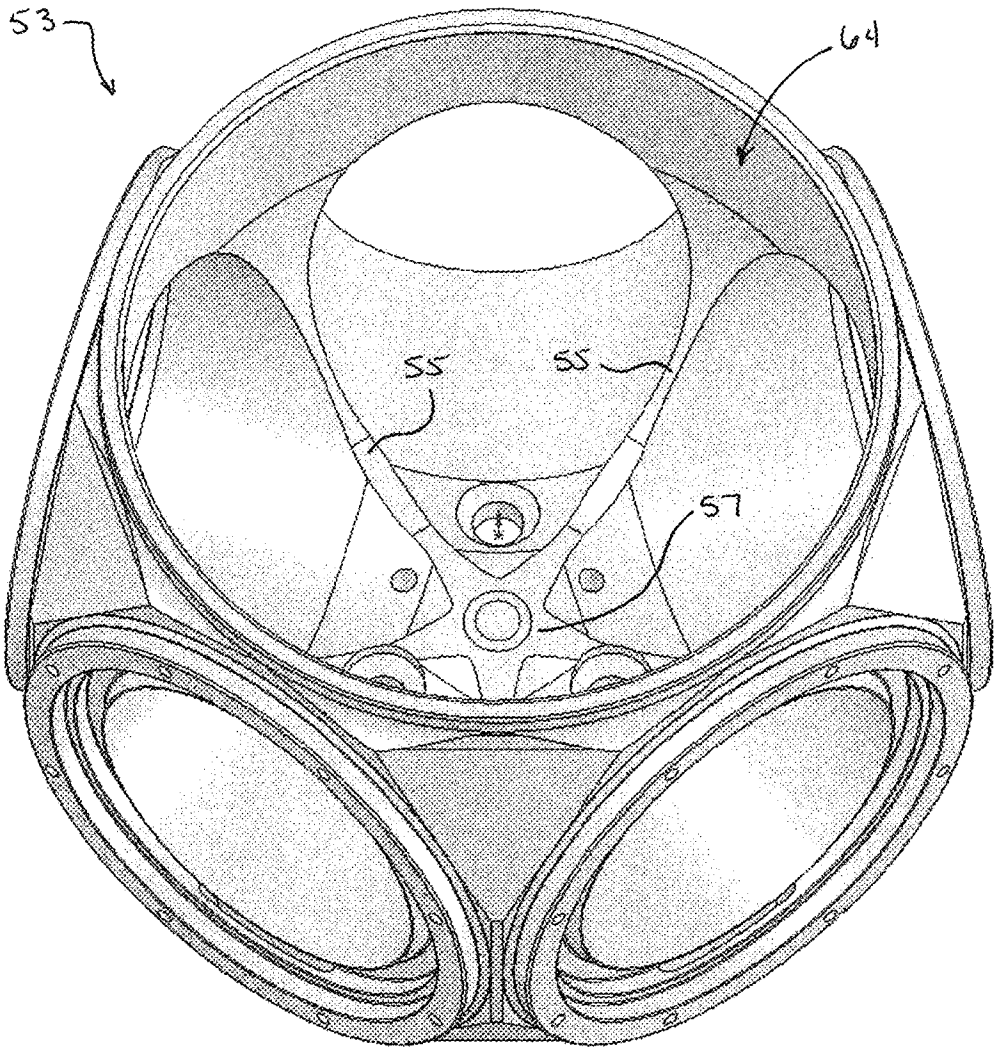
FIG. 22 is a perspective view representing an alternative base for the impeller assembly of FIGS. 14 through 17.

Another distinguishing feature of the assembly 50 shown in FIGS. 14 through 17, as compared to the prior art impeller assemblies 18 of FIGS. 7 through 13, relates to the shape of the interior walls 55, where the walls 55 meet the floor 57 of the base 53 of the assembly 50, and the relative shape and size of the floor 57 relative to the overall interior diameter of the cavity 64 within the base 53. FIGS. 7 through 13 represent the interior walls 44 of the prior art impeller assemblies 18 as arcuate in the vertical direction, narrow in the circumferential direction (to the extent that the walls 44 effectively define an edge as seen in FIG. 13), and extending about 90% of the radial distance to the center of their respective cavity 43, such that only a small fraction of the floor 46 (labeled in FIGS. 7 and 8) of the cavity 43 is flat. In contrast, the interior walls 55 of the impeller assembly 50 of FIGS. 14 through 17, though also arcuate in the vertical direction, are much wider in the circumferential direction and extend not more than about 25% of the radial distance to the center of the cavity 64, such that a large fraction of the floor 57 of the cavity 64 is flat. This aspect is particularly evident in FIG. 21, which is an isolated view of the base 53 and shows the floor 57 as flat and having a circular perimeter. For comparison, an alternative configuration for the base 53 is shown in FIG. 22 as having interior walls 55*a* more similar to that of the impeller assemblies 18 of FIGS. 7 through 13, i.e., narrow in the circumferential direction and extending about 90% of the radial distance to the center of the cavity 64, such that only a small fraction of the floor 57 of the cavity 64 is flat. The volume of the cavity 64 represented in FIG. 21 is about 15% greater than the volume of the cavity 64 represented in FIG. 22 due to the more radially intrusive interior walls 55*a* of the latter.

Figure 16:
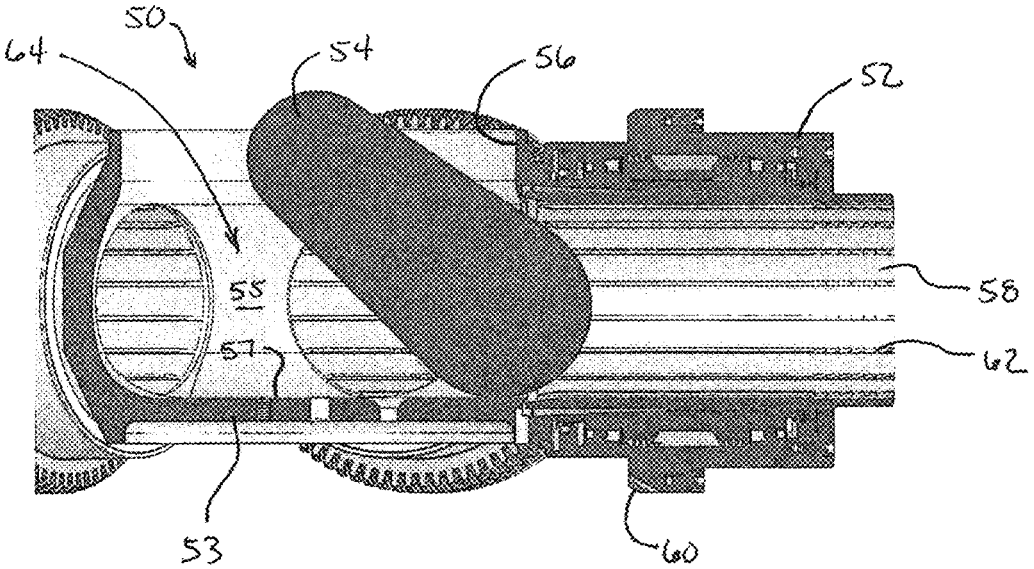
Figure 17:
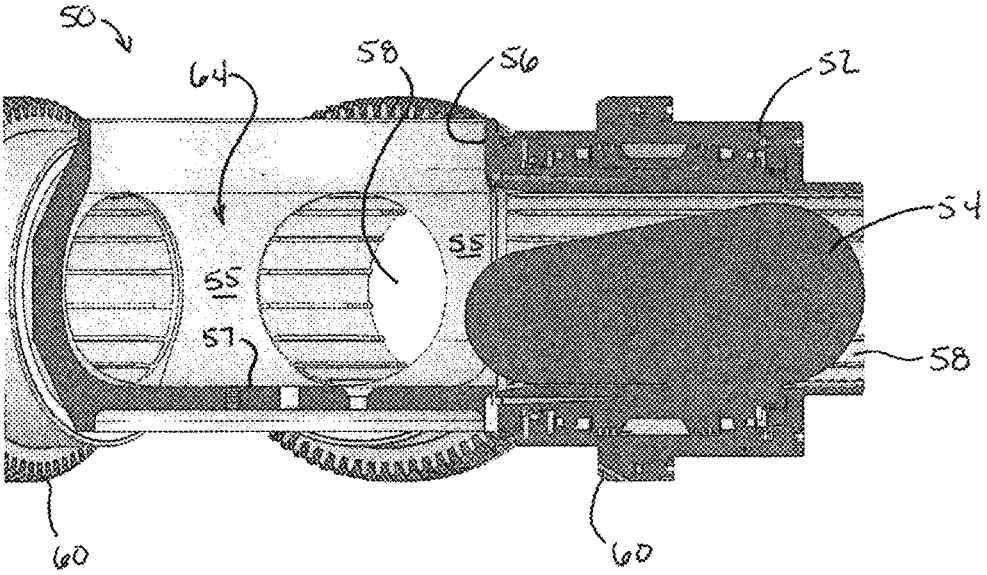

As represented in FIGS. 16 and 17, a product 54 delivered to the impeller assembly 50 enters through a central opening 56 in the base 53 (e.g., from the hopper 22 of FIGS. 2 through 4) before being delivered to one of the passages 58 within a tubular guide 52. The impeller assembly 50, including its tubular guides 52, rotates about a vertical axis shared with the cutting head, such that within the passage 58 the product 54 is subjected to centrifugal forces that cause the product 54 to travel through the passage 58 in a radially outward direction until the product 54 engages one or more circumferentially-spaced knives of the cutting head, which the product 54 encounters in regular succession to produce slices of the product 54. Each tubular guide 52 has a toothed flange 60 that engages a stationary ring (not shown) so that rotation of the impeller assembly 50 about its vertical axis causes each of the tubular guides 52 to rotate in unison about their respective longitudinal axes. With the assistance of longitudinal splines 62 within the interior passage 58 of the tubular guide 52, the product 54 also rotates about its horizontal axis as the impeller assembly 50 rotates about its vertical axis. As centrifugal forces hold the product 54 firmly against the cutting head, the tubular guide 52 causes the product 54 to turn (for example, a approximately one-quarter turn) between each knife of the cutting head to result in a desired lattice cut being generated in slices as the knives are encountered.

FIGS. 16 and 17 evidence the ability of the impeller assembly 50 to readily accommodate a large product 54. A scaled comparison of the impeller assembly 50 in FIG. 14 with the prior art impeller assembly 18 in FIG. 13 evidences that, though both assemblies 18 and 50 have similar outer dimensions (e.g., based on the outer radial extents of their tubular guides 24 and 52), the impeller assembly 50 has a much larger central opening 56 and a much larger cavity 64 within the base 53 in which the product 54 is received prior to entering one of the passages 58. In the particular embodiment of FIGS. 14 through 17, the diameter of the opening 56 is about 40% larger than the diameter of the opening 42 of the impeller assembly 18 of FIG. 13, and the cavity 64 is about 200% larger than the cavity 43 of the impeller assembly 18 of FIG. 13. As a result, the impeller assembly 50 is able to more readily accommodate large elongate products (e.g., potatoes) in terms of being able to transition from vertical to horizontal within the cavity 64, in addition to having longer tubular guides 52 than the assembly 18 of FIGS. 7, 9, and 11 to reduce the risk of undesired interaction between products being sliced and subsequent products entering the cavity 64. Consequently, the impeller assembly 50 is capable of much higher product throughput with no increase in, and more likely a reduced incidence of, product jamming.

Figure 15:
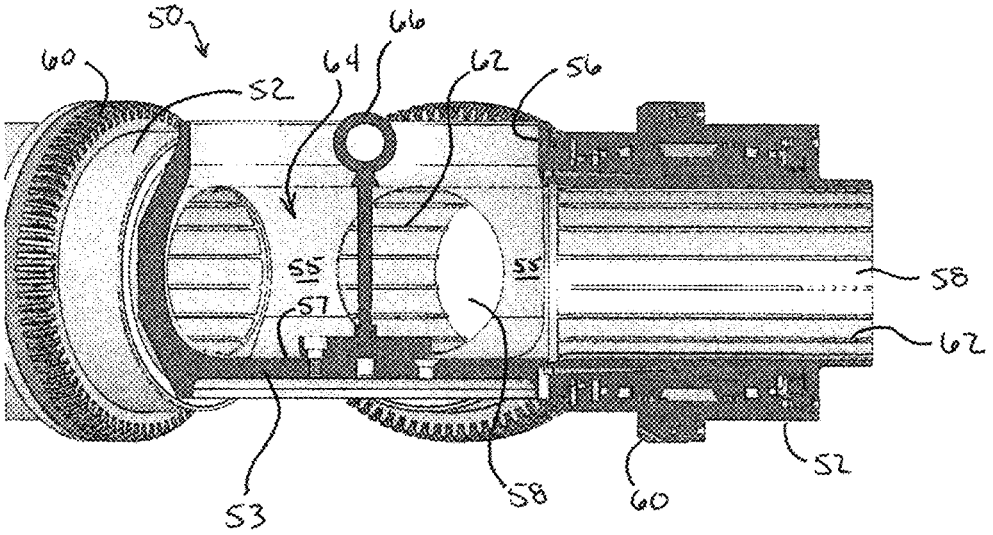
FIGS. 15, 16, and 17 are cross-sectional views of the impeller assembly of FIG. 14, and FIGS. 16 and 17 represent the progress of a product introduced into the impeller assembly for slicing.

FIGS. 14 and 15 show a removable lift ring 66 within the cavity 64 and secured to the floor 57 of the base 53 to facilitate lifting of the impeller assembly 50 with a gantry or other suitable lifting device. As indicated in FIGS. 16 and 17, the lift ring 66 is preferably removed prior to operating the impeller assembly 50.

Figure 18:
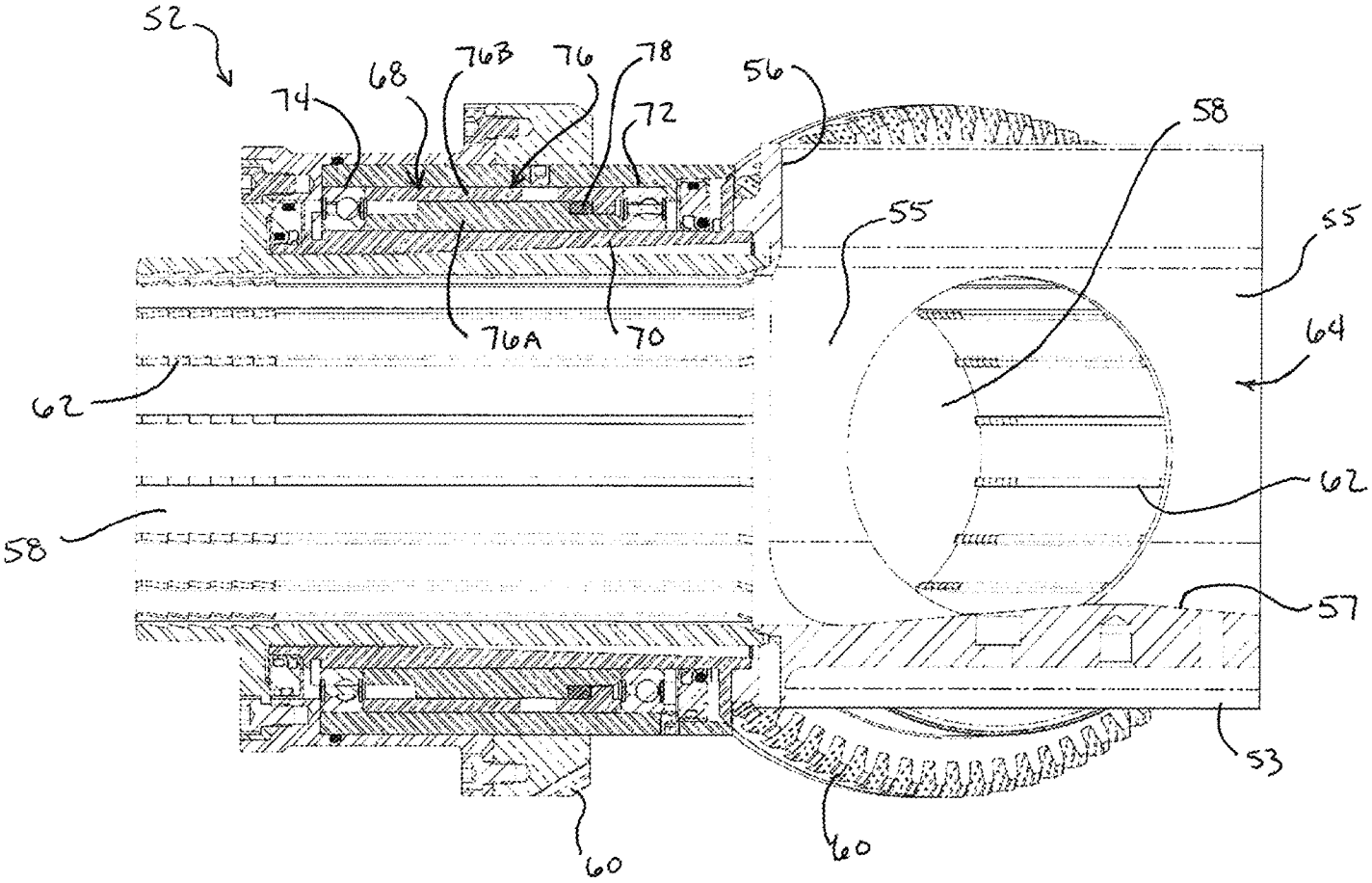
FIG. 18 is a cross-sectional view of one of the tubular guides of the impeller assembly of FIGS. 14 through 17.
Figure 19:
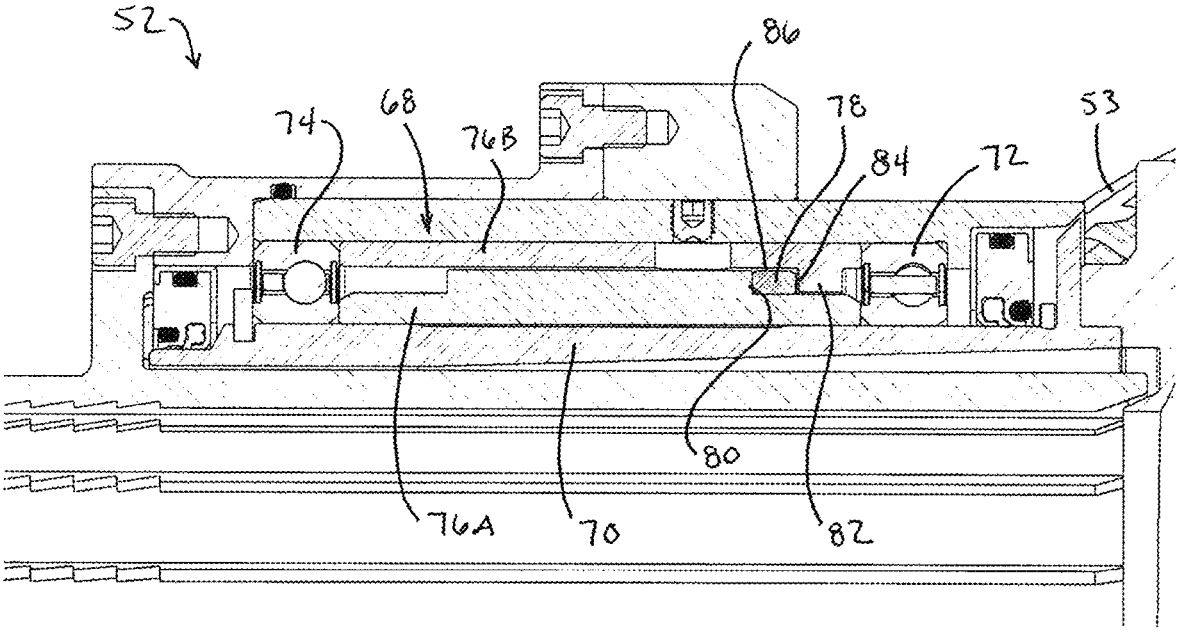
FIGS. 19 and 20 compare the appearance of a bearing assembly of the tubular guide of FIG. 18 before and after the failure of a bearing.
Figure 20:
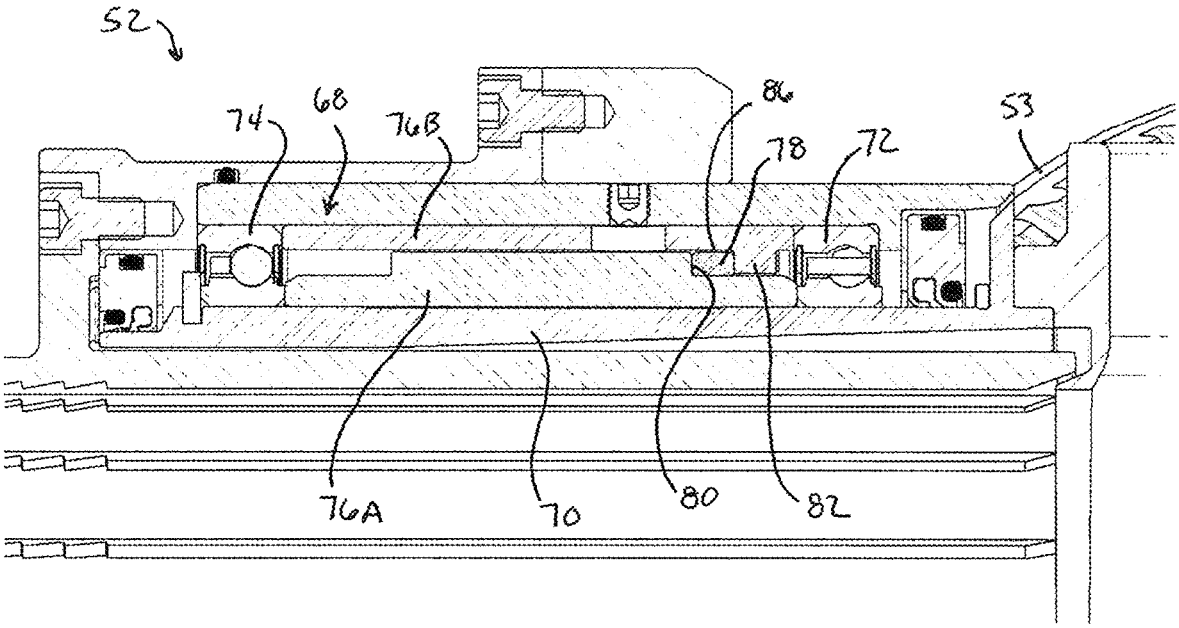

As an additional but optional aspect, FIGS. 18, 19, and 20 represent details of a bearing assembly 68 that supports the tubular guide 52 on a cylindrical-shaped mounting tube 70 secured to and extending from the base 53 of the impeller assembly 50. The bearing assembly 68 enables the tubular guide 52 to rotate on the mounting tube 70 about their coinciding longitudinal axes, thereby enabling the tubular guide 52 to rotate with respect to the base 53 of the impeller assembly 50. The bearing assembly 68 comprises at least two bearings 72 and 74 that are axially spaced apart along the mounting tube 70, and a spacer 76 between the bearings 72 and 74. The radially inward-most bearing 72 carries an axial load acting in the radially outward direction (to the left in FIG. 18) due to the tubular guide 52 being subjected to centrifugal forces caused by the rotation of the impeller assembly 50.

The spacer 76 comprises two spacer sleeves, an inner spacer sleeve 76A contacting the mounting tube 70 and engaging the inner races of the bearings 72 and 74, and an outer spacer sleeve 76B between the tubular guide 52 and inner spacer sleeve 76A and engaging the outer races of the bearings 72 and 74. As such, the spacer sleeve 76B is able to rotate with the tubular guide 52, and the spacer sleeve 76A does not rotate (aside from rotating with the entire impeller assembly 50 about the axis of the assembly 50). The sleeves 76A and 76B preferably have identical or nearly identical axial lengths. A sacrificial ring 78 is disposed in an annular space 86 defined by and between a shoulder 80 of the nonrotating spacer sleeve 76A and a flange 82 of the rotating spacer sleeve 76B. As better seen in FIG. 19, an axial gap 84 is present between the flange 82 of the rotating spacer sleeve 76B and the sacrificial ring 78 to permit the rotating spacer sleeve 7B to rotate relative to the nonrotating spacer sleeve 76A.

As represented in FIG. 20, in the event of either one of the bearings 72 and 74 failing, the entire tubular guide 52 shifts radially outward (to the left in FIGS. 18, 19, and 20) due to centrifugal forces. If unimpeded, the radially outward end of the tubular guide 52 could impact the knives of the cutting head in which the impeller assembly 50 is rotating. The gap 84 allows the rotating spacer sleeve 76B engaging the outer races of the bearings 72 and 74 and the entire tubular guide 52 to shift toward the knives but not enough for the end of the tubular guide 52 to impact the knives. Instead, the rotating spacer sleeve 76B abuts the sacrificial ring 78, resulting in contact between the spacer sleeve 76B and sacrificial ring 78 as well as increased contact between the sacrificial ring 78 and spacer sleeve 76A. As such, the axial gap 84, shoulder 80 of the nonrotating spacer sleeve 76A, and flange 82 of the rotating spacer sleeve 76B cooperate to prevent contact between the tubular guide 52 and knives in the event of a bearing failure. For this reason, the axial gap 84 is preferably limited, as a nonlimiting example, to about 0.020 inch. Contact between the sacrificial ring 78 and spacer sleeves 76A and 76B quickly increases the torque demand on the motor used to rotate the impeller assembly 50, and the resulting increase in amperage drawn by the motor can be utilized to send a signal to shut the machine down to allow replacement of the bearings 72 and/or 74. Contact between the spacer sleeves 76A and 76B and sacrificial ring 78 can also act as an internal brake to stop or at least sufficiently inhibit the rotation of the impeller assembly 50 before subsequent damage occurs.

While the invention has been described in terms of specific embodiments, it is apparent that other forms could be adopted by one skilled in the art. For example, the impeller assembly 50 and its components could differ in appearance and construction from the embodiment shown in the drawings and used with machines and cutting heads that differ in appearance and construction from what is shown in the drawings, certain functions of the impeller assembly 50 and its components could be performed by components of different construction but capable of a similar (though not necessarily equivalent) function, and various materials and processes could be used to fabricate the impeller assembly 50 and its components. As such, it should be understood that the above detailed description is intended to describe the particular embodiments represented in the drawings and certain but not necessarily all features and aspects thereof, and to identify certain but not necessarily all alternatives to the represented embodiments and their described features and aspects. As a nonlimiting example, the invention encompasses additional or alternative embodiments in which one or more features or aspects of a particular embodiment could be eliminated or two or more features or aspects of different embodiments could be combined. Therefore, the scope of the invention is to be limited only by the following claims.

The invention claimed is:

1. A slicing machine for slicing products, the slicing machine comprising:

a cutting head having an annular shape that defines an axis of the cutting head, the cutting head having at least one knife at a perimeter thereof and extending radially inward of the cutting head; and an impeller assembly coaxially mounted within the interior of the cutting head for rotation about an axis of the impeller assembly in a rotational direction relative to the cutting head, the impeller assembly comprising a base, the base comprising a floor and interior walls that define a cavity within the base, openings in the interior walls, and a central opening to the cavity within the base, the interior walls having interior surfaces at a radial distance from a center of the cavity to define an interior diameter of the cavity, the floor, the cavity, and the central opening of the base being arranged in an axial direction of the impeller assembly, each adjacent pair of the openings being separated by a corresponding one of the interior walls of the base, each of the interior walls being arcuate in the axial direction of the impeller assembly, and each of the interior walls extending toward the center of the cavity to meet the floor of the base not more than 25% of the radial distance to the center of the cavity, the impeller assembly further comprising an odd number of equi-angularly spaced tubular guides each extending radially outward from the base and having a passage therein in communication with one of the openings of the base for delivering products within the cavity toward the perimeter of the cutting head as the impeller assembly rotates within the cutting head, each of the tubular guides rotating about an axis thereof so that products within the tubular guides rotate about axes thereof while the impeller assembly rotates about the axis of the cutting head;

wherein each of the tubular guides is supported on a mounting tube by a bearing assembly comprising at least two bearings that are axially spaced apart along the mounting tube and a spacer between the bearings, the spacer comprising:

an inner spacer sleeve contacting the mounting tube and engaging inner races of the bearings;

an outer spacer sleeve between the tubular guide and the inner spacer sleeve and engaging outer races of the bearings such that the outer spacer sleeve is able to rotate with the tubular guide and the inner spacer sleeve does not rotate; and a sacrificial ring disposed in an annular space defined by and between a shoulder of the inner spacer sleeve and a flange of the outer spacer sleeve, wherein an axial gap is present between the flange of the outer spacer sleeve and the sacrificial ring to permit the outer spacer sleeve to rotate relative to the inner spacer sleeve, and in the event that either of the bearings of a tubular guide fails, the tubular guide shifts radially outward due to centrifugal forces and the outer spacer sleeve abuts the sacrificial ring resulting in contact between the outer spacer sleeve and sacrificial ring to prevent contact between the tubular guide and the knives of the cutting head.

2. The slicing machine of claim 1, wherein the odd number of tubular guides is five.

3. The slicing machine of claim 1, wherein each of the openings of the passages is directly diametrically opposite one of the interior walls of the base.

4. A method of using the slicing machine of claim 1 to produce slices or chips of a lattice type, the method comprising:

rotating the impeller assembly;

supplying products to the impeller assembly;

delivering the products to the perimeter of the cutting head through action of rotating the impeller assembly and the delivering means; and slicing the products with the corrugated knife to produce the slices or chips of the lattice type.

5. The method of claim 4, wherein the products are food products.

6. A slicing machine for slicing products, the slicing machine comprising:

a cutting head having an annular shape that defines an axis of the cutting head, the cutting head having at least one knife at a perimeter thereof and extending radially inward of the cutting head; and an impeller assembly coaxially mounted within the interior of the cutting head for rotation about the axis of the cutting head in a rotational direction relative to the cutting head, the impeller assembly comprising a base, a cavity within the base, a central opening to the cavity within the base, a number of equi-angularly spaced mounting tubes extending from the base, and tubular guides each rotatably mounted on one of the mounting tubes and having a passage therein for delivering products within the cavity toward the perimeter of the cutting head as the impeller assembly rotates within the cutting head, each of the tubular guides rotating about an axis thereof so that products within the tubular guides rotate about axes thereof while the impeller assembly rotates about the axis of the cutting head;

wherein each of the tubular guides is supported on a corresponding one of the mounting tubes by a bearing assembly comprising at least two bearings that are axially spaced apart along the mounting tube and a spacer between the bearings, the spacer comprising:

an inner spacer sleeve contacting the mounting tube and engaging inner races of the bearings;

an outer spacer sleeve between the tubular guide and the inner spacer sleeve and engaging outer races of the bearings such that the outer spacer sleeve is able to rotate with the tubular guide and the inner spacer sleeve does not rotate; and a sacrificial ring disposed in an annular space defined by and between a shoulder of the inner spacer sleeve and a flange of the outer spacer sleeve, wherein an axial gap is present between the flange of the outer spacer sleeve and the sacrificial ring to permit the outer spacer sleeve to rotate relative to the inner spacer sleeve, and in the event that either of the bearings of a tubular guide fails, the tubular guide shifts radially outward due to centrifugal forces and the outer spacer sleeve abuts the sacrificial ring resulting in contact between the outer spacer sleeve and sacrificial ring to prevent contact between the tubular guide and the knives of the cutting head.

7. The slicing machine of claim 6, wherein the number of mounting tubes is an odd number.

8. The slicing machine of claim 7, wherein each of the passages has an opening to the cavity that is directly diametrically opposite an interior wall between and separating openings to the passages of an adjacent pair of the tubular guides.

9. The slicing machine of claim 6, wherein the inner and outer spacer sleeves have identical axial lengths.

* * * * *